United States Patent [19]

Headrick et al.

[11] 4,082,212

[45] Apr. 4, 1978

[54] GALVANIZED TUBE WELDED SEAM REPAIR METALLIZING PROCESS

[75] Inventors: J. Charles Headrick, Oceola, Ark.; R. Emory Starnes, Carrollton, Ga.; Robert C. Peel, Ranburne, Ala.

[73] Assignee: Southwire Company, Carrollton, Ga.

[21] Appl. No.: 667,066

[22] Filed: Mar. 15, 1976

[51] Int. Cl.[2] ..... B23K 31/06

[52] U.S. Cl. ..... 228/147; 29/527.4; 118/8; 118/DIG. 11; 228/18; 228/20; 228/176; 228/199; 427/406

[58] Field of Search ..... 29/527.2, 527.4; 228/18, 147, 176, 199, 125, 20; 427/406, 422, 423, 424; 118/8, 314, DIG. 11

[56] References Cited

U.S. PATENT DOCUMENTS

| | | | |
|---|---|---|---|
| 3,320,040 | 5/1967 | Roe et al. | 427/406 X |
| 3,370,151 | 2/1968 | Normando | 228/9 X |
| 3,827,139 | 8/1974 | Norteman | 29/527.2 |

FOREIGN PATENT DOCUMENTS

| | | | |
|---|---|---|---|
| 1,841 | 1/1971 | Japan | 228/125 |

OTHER PUBLICATIONS

Alloy Digests: Al-44 (Feb. 1974) and Al-104 (June 1961); Engineering Alloys Digest, Inc., New Jersey.

*Primary Examiner*—Gary L. Smith
*Assistant Examiner*—K. J. Ramsey
*Attorney, Agent, or Firm*—Herbert M. Hanegan; Stanley L. Tate; Robert S. Linne

[57] ABSTRACT

Metallic tubing is manufactured from galvanized steel strip by forming the strip into tubular shape, welding the edges together and replacing the zinc lost in welding by atomization metallizing the weld zone first with an aluminum alloy containing from more than about 0.30 to about 0.95 weight percent iron and then with zinc.

8 Claims, 2 Drawing Figures

GALVANIZED TUBE WELDED SEAM REPAIR METALLIZING PROCESS

BACKGROUND OF THE INVENTION

This invention relates to the manufacture of metallic tubing. It is more particularly concerned with a method for manufacturing thin-walled zinc coated electrical metallic tubing, fence post tubing, ladder railings and the like, and with the tubing so produced.

The uses of fence post tubing, ladder railings and the like are self explanitory and are well known. Generally such tubing is produced by the same process as described for electrical metallic tubing. Electrical metallic tubing is used for metal raceways for the installation of electrical wires and cables. Large quantities of this tubing are made of steel in size ranges from nominal ⅜ inch to nominal 4 inch diameter. The tubing is relatively thin-walled, having a wall thickness of about 0.042 inch in the smallest sizes and increasing to about 0.083 inch for nominal 4 inch tubing. Steel tubing of this type is conventionally made by forming a flat blank into a tube and welding the edges together. The smaller sizes of electrical metallic tubing are often bent in fabrication and must be able to withstand bending without cracking, rupture or collapse. Tubing of ½ inch nominal or trade size, for example, must be able to withstand bending into a semi-circle the inner edge of which has a radius of 3½ inches and subjected to a hydrostatic pressure of 30–50 psi to test for seam cracks or openings.

Steel tubing of this type is commonly protected by a zinc coating. The tubing after forming and welding is conventionally hot dip galvanized, electro-galvanized or seam metallized so that the weld is coated to the same extent as the remainder of the surface. The Underwriters' Laboratories require that the galvanized coating on the exterior of the tubing meet certain thickness standards described hereinafter. These standards do not apply to the coating on the inside of the tube, but that coating must protect the tubing against corrosion. In practice, therefore, the inside surface of the formed tubing is spray or flow coated with an enamel, paint or other acceptable coating.

The coating thickness test specified by the Underwriters' Laboratories is commonly known as the Preece test and is described in detail in the Underwriters' Laboratories standards for electrical metallic tubing. UL 797. Specimens of the zinc coated steel are immersed or dipped in a copper sulfate solution of prescribed strength for sixty seconds and are then removed and washed in running water. The zinc from the specimen displaces copper from the solution, which plates out on the specimen. The copper does not adhere strongly to zinc, however, and the loosely adhering deposits are removed by washing in water, followed by wiping the specimen with cheesecloth. The procedure described is then repeated, to an end point described hereinafter. The coating thickness is determined by the number of successive dips which the coating can withstand without dissolving to the steel base. When the zinc is removed down to the iron, which also displaces copper from the solution, the copper adheres firmly to the iron and cannot be washed or rubbed off. The zinc coating of electrical metallic tubing must withstand four such immersions or dips without showing a final firm deposit of copper.

SUMMARY OF THE INVENTION

It is economically advantageous to manufacture various types of tubing, including electrical metallic tubing, with an outside coating of zinc which meets the Underwriters' Laboratories requirements above set out but with an inside coating only thick enough to prevent corrosion, and it is the principal object of this invention to provide such tubing. Another object is to provide a process of manufacturing such tubing. Other objects of this invention will appear in the course of the description thereof which follows.

It has been found that metallic tubing can be formed and welded from galvanized steel strip provided with a relatively heavy coating of zinc on the side which forms the outside of the tubing and with a relatively lighter coating of zinc on the side which forms the inside of the tubing. The zinc which is unavoidably melted or volatilized in the weld area by the heat of welding or removed by subsequent scarfing is replaced by atomization metallizing in the way hereinafter described. Tubing produced according to this process meets Underwriters' Laboratories specifications for electrical metallic tubing.

Economic considerations require that the metallizing be done in line with the continuous forming and welding operation. Previously,, attempts have been made to do this with zinc, but none of these produced zinc coatings which meet the Underwriters' Laboratories bend test. In atomization metallizing the coating metal is melted and atomized onto the surface to be coated. The atomization device, usually called a gun, is fed with coating metal in wire or powder form and after melting discharges the atomized coating metal onto the tubing. As the tubing is formed and welded at speeds in excess of 100 feet per minute, and the width of the area requiring metallizing is quite small, on the order of 3/16 inch, the restrictions thus imposed on metallizing are severe. In order to meet the Underwriters' Laboratories coating thickness requirements it would appear that a substantial thickness of zinc must be deposited on the substrate, moving at the speeds above mentioned. When it is attempted to deposit a reasonably thick coating of zinc by metal spraying, particularly on a hot substrate such as a welded tube, the heat input tends to cause the deposited zinc to volatilize or sublime. The more zinc deposited on the metal the more this tendency increases, leading toward an equilibrium condition in which the deposition of more molten zinc results in the volatilization of an equal amount of zinc.

In experiments it has proved impossible, using one gun only, to continuously spray metallize with zinc the weld zone of continuously welded tubing coming from the welder so as to deposit consistently a coating which met the Underwriters' Laboratories test previously described. Processes using two zinc guns in tandem produced no better results. Adjustment of the relative amounts of zinc sprayed by each gun resulted in little improvement. Generally these zinc coatings were non-uniform in thickness being thinnest at the weld seam, indicating need for a better substrate and heat control application at weld zone area. Experiments were also made with a process in which commercially available EC (electrical conductor grade) aluminum was sprayed first and then zinc was sprayed onto it, but the resulting product was not satisfactory.

It has been discovered that steel tubing can be satisfactorily atomization metallized continuously along the weld in line with the tube-forming and welding apparatus by a two-stage process in which zinc is melted and atomized onto the tubing in the second stage, in an area which includes the weld area. Such tubing made from galvanized strip meets all the requirements for fence post tubing, ladder railing and the like and all Underwriters' Laboratories standards for electrical metallic tubing. It has also been discovered that improved results can be obtained by a two-stage process in which the first stage comprises atomizing onto the tubing an aluminum alloy containing from more than about 0.30 to about 0.95 weight percent iron, with associated trace elements normally present in commercially available aluminum and the second stage comprises atomizing zinc onto the aluminum alloy coated tubing as described above.

BRIEF DESCRIPTION OF THE DRAWINGS

An arrangement suitable for carrying out this process is schematically illustrated in the attached figures.

DESCRIPTION OF THE PREFERRED EMBODIMENTS

Figure 1:
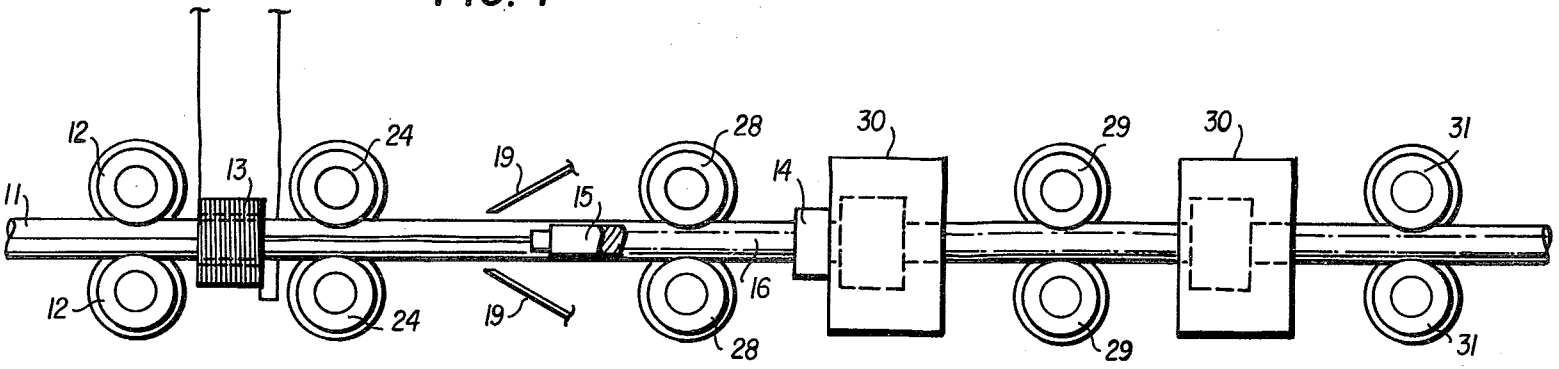
FIG. 1 is a plan view.
Figure 2:
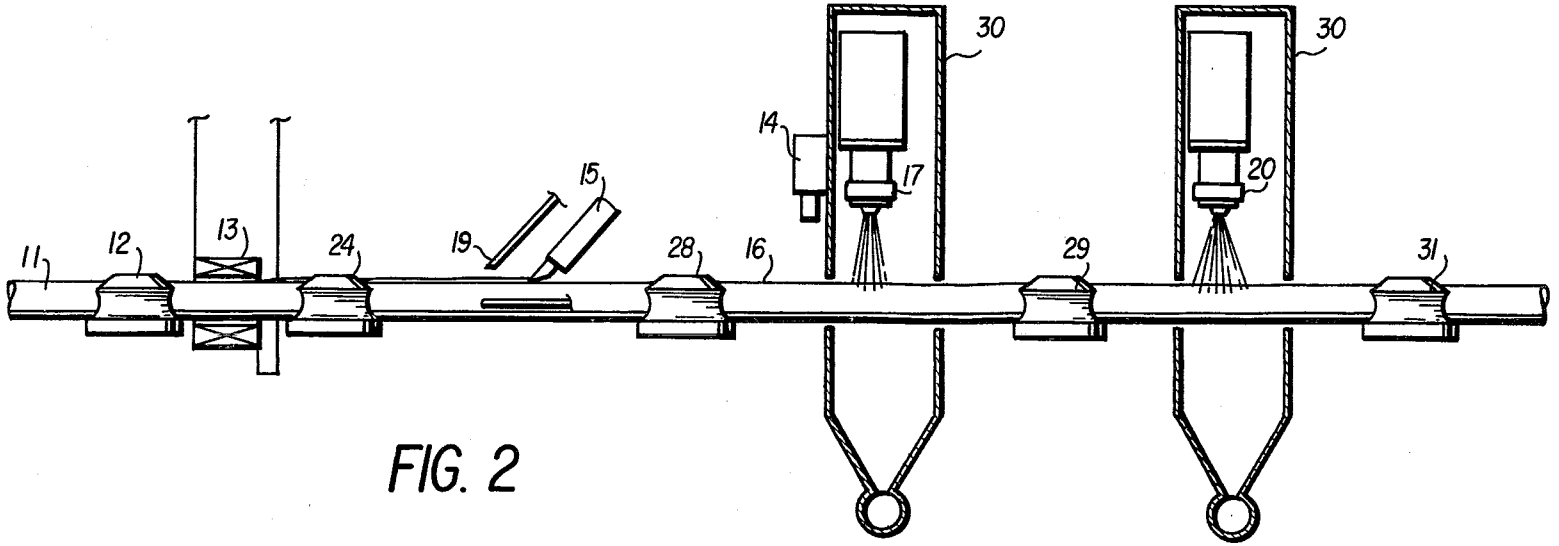
FIG. 2 is an elevational view of apparatus arranged for continuous welding and spray atomization metallizing of tubing.

In one embodiment of this invention there is provided steel strips of the desired gauge with a coating of zinc which is thicker on one side of the strip than on the other. This differential coating is produced either by hot dip galvanizing or by electro-galvanizing by known methods. The strip width required for tubing is relatively narrow compared to the width of strip which can be galvanized in a modern strip galvanizing installation, and as it is more economical to galvanize strip in relatively wide width than in narrow width, it is preferable to galvanize strip in widths which are multiples of the strip widths required for tubing and then to slit the strip. The slit strip then is fed into the tube forming process of this invention.

The tube bending apparatus is not shown as it is ancillary to this process. Tubing 11 may be produced from known materials including commercially available differentially galvanized steel and the like. The tubing 11, bent to shape with its edges abutting, passes from left to right through a pair of contoured rolls 12—12 which force the edges of the tubing together. Immediately downstream of rolls 12—12 the tubing passes through an induction coil 13 of a high frequency induction welder, being positioned so as to not make contact with tubing 11. Alternatively induction sliding contacts may be used to contact tubing 11. The edges of the tubing are welded together by inducing current through them from the coil 13 while the edges are held in abutment by a second pair of contoured rolls 24—24. The welded tubing occasionally emerges with an outside flash 18 which can be removed by optional scarfing knife 15 which is moveably mounted so that it may be positioned to engage any outside flash on tubing 11 or may be raised so as not to engage said outside flash. The weld may also have an inside flash which can be ironed or compressed by ironing means not shown.

The tubing 11 after passing contour rolls 24—24 has a narrow welded zone 16 from which the original zinc coating has been melted off or volatilized in the welding and which may have been scraped clean by optional scarfer knife 15. Optional air injector 19 may be used in place of or in addition to, scarfer knife 15 to clean the tubing of foreign matter and/or outside flash. At the tubing speeds associated with this process air injector 19 usually removes a sufficient amount of flash, etc., so that scarfer knife 15 is seldom needed. An optional pair of contoured rolls 28—28 may be positioned downstream from injector 19. These rolls when in use contact the tubing and closely control any movement of the tubing perpendicular to its direction of travel. Downstream from optional rollers 28 the moveably mounted aluminum alloy atomization metallizing gun 17 is positioned directly above the welded zone 16 of the tubing 11 and adjusted to direct the atomized aluminum alloy substantially vertically downward onto tubing 11. The spray of gun 17 covers the area of weld zone 16 with some overspray. An optional set of rollers 29 may be positioned downstream of gun 17. When in use rollers 29 closely control the movement of tubing 11 perpendicular to its direction of travel.

Moveable mounted zinc atomization metallizing gun 20 is positioned downstream of aluminum alloy atomization metallizing gun 17 directly above the weld zone 16 of tubing 11 and directs the atomized zinc substantially downwardly onto the weld zone 16 of tubing 11. Gun 20 is adjusted so that the spray covers the area of weld zone 16 with some overspray.

The tandem metal atomizing guns are necessarily positioned downstream of the welder and should be spaced therefrom a distance sufficient for the weld area of the tube to have cooled somewhat from the fusion temperature reached in welding.

Guns 17 and 20 may be operated within an enclosure 30 which has openings for tube 11 to travel therethrough in order to prevent the escape of any atomized metal into the atmosphere. Alternately guns 17 and 20 may be operated within individual enclosures. Both gun 17 and gun 20 are mobile and are moveable parallel to the direction of travel of tubing 11. Guns 17 and 20 are capable of moving as a unit or individually, their movement being controlled by the temperature of weld zone 16 of tubing 11. It is difficult to obtain the precise numerical temperature of weld zone 16 of tubing 11 however a numerical reference can be established by setting the emittance at 1 on an infrarometer 14 and establishing a correlation of readings to that of acceptable control range values at which the tubing seam repair process of this invention functions best. Tests have shown these readings to be from about 350° reference to about 650° F reference. The preferred range of readings at which the process of this invention functions best is from about 400° reference to about 475° F reference. Tests have revealed that at less than 350° F reference the seam repair is brittle and flaky when the tubing 11 is bent and that at above 650° F reference the coverage of the repair seam is sparse since the heat allows the material to flow from the top to the sides of the tubing thereby providing insufficient seam repair coverage. Gun 17 contains an infrared sensing device 14 which is adjusted to seek out certain reference temperatures of weld zone 16 of tubing 11. Guns 17 and 20 then move as a unit to seek out the desired temperatures for the most efficient metallizing of weld zone 16. Gun 20 may be manually set to a reference distance from gun 17 for position of advantageous operation application. Optionally gun 20 may contain an infrared sensing device which is adjusted to seek out certain reference temperatures of weld zone 16 of tubing 11. Gun 20 then may move either individually or as a unit with gun 17 to seek out the desired temperatures for the most efficient metallizing of weld zone 16. An optional set of rollers 31 may be positioned downstream of gun 20. When in use rollers 31 closely control the movement of tubing 11 perpendicular to its direction of travel.

For efficient operation and safety reasons the entire process is connected so that the process starts in a timed sequence and stops immediately in the event of a failure in the operation of the induction coil 13, guns 17 or 20 or any environmental or safety apparatus such as dust collectors and the like.

As mentioned above the coating metal is fed to the atomization metallizing spray guns in the form of wire or powder. It is preferred to supply the zinc atomizing gun used in this process with zinc in the form of wire of 0.090 inch diameter. Optionally the 0.090 inch wire supplied to the zinc atomizing gun may be an alloy of zinc and aluminum or zinc and aluminum alloy. It is preferable to supply the aluminum alloy atomization metallizing gun with aluminum alloy in the form of wire 0.090 inch diameter. The rate of metal deposit varies with the linear speed of the tubing being repaired. Specimens of the product coated by the embodiment of this process comprising atomization metallizing with aluminum alloy and then with zinc exhibit the minimum coating thickness sufficient to satisfy fence post tubing and ladder railing requirements and the Underwriters' Laboratories coating test previously mentioned.

It will be understood that welded tubing coming from a mill as above described is effected by vibration and other disturbances so that it may move closer to or farther away from the spray gun. In such case the width of the area to be covered decreases or increases, respectively. The operating techniques of the forming tube mill, sizing mill, flying shear cutoff, roller supports and controlled overspray reduce this effect on the weld zone coverage. The guns 17 and 20 are moveably mounted allowing perpendicular movement toward and away from tubing 11 and also allowing tilting movements from a line perpendicular to the direction of travel of tube 11.

Although this invention is described and illustrated by a process as carried out with high frequency induction welding it is equally applicable to tubing produced by resistance welding.

The foregoing specification describes a presently preferred embodiment of this invention, however, it will be understood that this invention can be otherwise embodied within the scope of the following claims.

We claim:

1. A method of manufacturing zinc coated steel tubing from zinc coated steel strip in which the zinc has been applied directly to the steel strip comprising continuously passing said zinc coated steel strip along a path and sequentially performing thereon the following steps:

a. forming said strip into tubular form and bringing the edges thereof into abutting relation, b. welding the edges together and thereby volatilizing zinc from the weld area, c. restoring the zinc coating to the weld area by spray atomization metallizing that area in two sequential stages, said restoring step including continuously sensing the temperature of the weld area and automatically adjusting the point of application of the sprayed coating in response to said sensed temperature, d. the first stage comprising spraying atomized molten aluminum alloy containing from more than about 0.30 to about 0.95 weight percent iron, with associated trace elements normally present in commercially available aluminum thereon, e. the second stage comprising spraying atomized molten zinc thereon, f. the combined coatings applied in steps (d) and (e) providing a coating of substantially the same thickness as the original zinc coating on the steel strip.

2. The method of claim 1 in which step *c* is carried out after the weld area has cooled to a temperature below the melting point of the coating metal.

3. The method of claim 1 wherein step (e) comprises spraying a molten alloy of zinc and aluminum onto the weld area.

4. Apparatus for manufacturing zinc coated steel tubing from zinc coated steel strip in which the zinc has been applied directly to the steel strip, comprising means for moving said strip along a path of travel, means for forming said strip into tubular shape with the lateral edges thereof in abutting relation, means for welding said edges together, the welding causing at least a portion of the zinc coating to be lost by volatilization, means for replacing the lost zinc by atomization metallizing the weld zone as the strip moves along said path of travel, said replacing means including first spray means for atomization metallizing the weld zone with an aluminum alloy coating containing from more than about 0.30 to about 0.95 weight percent iron, second spray means for atomization metallizing the aluminum alloy coated weld zone with a zinc coating, means for continuously sensing the temperature of the weld zone, and means for automatically adjusting the positions of said spray means along said path of travel in response to said sensed temperature.

5. The apparatus of claim 4 including means for cleaning said tubing after welding the edges thereof together and before atomization metallizing said tubing weld zone.

6. The apparatus of claim 5 wherein said cleaning means is a scarfer.

7. The apparatus of claim 5 wherein said cleaning means is an air injector.

8. The apparatus of claim 4 including at least one set of rollers arranged to contact said tubing immediately prior to an atomization metallizing means to prevent any substantial movement of said tubing perpendicular to said path of travel.

* * * * *